US010939211B2

(12) United States Patent
Chen

(10) Patent No.: US 10,939,211 B2
(45) Date of Patent: Mar. 2, 2021

(54) SHADING RING AND LOUDSPEAKERS

(71) Applicant: Tymphany Acoustic Technology (Huizhou) Co., Ltd., Huizhou (CN)

(72) Inventor: Zhi Chen, Huizhou (CN)

(73) Assignee: TYMPHANY ACOUSTIC TECHNOLOGY (HUIZHOU) CO., LTD., Huizhou (CN)

( * ) Notice: Subject to any disclaimer, the term of this patent is extended or adjusted under 35 U.S.C. 154(b) by 0 days.

(21) Appl. No.: 16/533,052

(22) Filed: Aug. 6, 2019

(65) Prior Publication Data

US 2020/0045443 A1 Feb. 6, 2020

Related U.S. Application Data

(60) Provisional application No. 62/715,112, filed on Aug. 6, 2018.

(51) Int. Cl.

| | |
|---|---|
| ***H04R 9/02*** | (2006.01) |
| ***H04R 9/04*** | (2006.01) |
| ***H04R 9/06*** | (2006.01) |

(52) U.S. Cl.

CPC ..... *H04R 9/025* (2013.01); *H04R 9/045* (2013.01); *H04R 9/06* (2013.01)

(58) Field of Classification Search

CPC ..... H04R 9/025; H04R 9/045; H04R 9/06; H04R 2209/027; H04R 2209/022; H04R 2209/021; H04R 9/02

See application file for complete search history.

(56) References Cited

U.S. PATENT DOCUMENTS

2006/0251286 A1* 11/2006 Stiles ..... H04R 9/025 381/421

FOREIGN PATENT DOCUMENTS

JP 2003199189 A * 7/2003

* cited by examiner

*Primary Examiner* — Brian Ensey

(74) *Attorney, Agent, or Firm* — Muncy, Geissler, Olds & Lowe, P.C.

(57) ABSTRACT

A shading ring is disposed in a magnetic circuit system. The magnetic circuit system includes a main magnet, a washer, a voice coil and a secondary magnet. The shading ring is located inside the voice coil. The shading ring includes a first ring body and a second ring body. The second ring body is formed by bending a lower end of the first ring body outward. The first ring body includes a first perpendicular portion and a first horizontal portion. A first cavity is formed inside the first perpendicular portion. The secondary magnet is located in the first cavity. The first horizontal portion is fixedly connected to an upward side of the secondary magnet. The shading ring is arranged into a structure having the first ring body and the second ring body.

10 Claims, 9 Drawing Sheets

SHADING RING AND LOUDSPEAKERS

CROSS REFERENCE TO RELATED APPLICATIONS

This application claims priority of U.S. Provisional Application No. 62/715,112 filed on Aug. 6, 2018 under 35 U.S.C. § 120, the entire contents of all of which are hereby incorporated by reference.

TECHNICAL FIELD

The present invention relates to the technical field of loudspeaker manufacturing, and in particular, to a shading ring and loudspeakers including the shading ring.

BACKGROUND

During a working process of a loudspeaker, while an external drive current drives a voice coil to vibrate in a magnetic gap, an induction current in a reverse direction is also caused. With excessively large self inductance of the voice coil, the generated induction current is large, which results in that the work of the loudspeaker is affected, and the frequency response is damaged.

For a loudspeaker having a conventional structure, a shading ring is disposed around a magnet and at a lower end of a washer to alleviate a rising speed of an electrical impedance value of the loudspeaker with a frequency. The shading ring may offset the influence of an induction current of the voice coil to a magnetic field in the loudspeaker, so that the nonlinear inductance of a magnetic material is reduced, the impedance of a high-frequency band of the loudspeaker is reduced, and the thus effects of reducing the harmonic distortion and reducing the inductance of the voice coil are taken.

In a loudspeaker having a secondary magnet, a shading ring is generally disposed inside a voice coil, and an adhesive side of the shading ring is disposed between the secondary magnet and a washer. However, for such an arrangement manner, the phenomenon that the secondary magnet is not firmly bond with the shading ring occurs frequently, which mainly lies in that a very strong repulsive force is formed between the secondary magnet and a main magnet, and the shading ring is generally made of a metal material and is lightweight and thus is greatly affected by the repulsive force.

Therefore, how to optimize a structure of the shading ring, and reduce or even eliminate the influence of the repulsive force to the shading ring is a technical problem to be solved by a person skilled in the art.

SUMMARY OF THE INVENTION

In order to solve the above problems in the prior art, the present invention provides a shading ring. The shading ring is arranged into a structure having a first ring body and a second ring body, and the connection relationships of the shading ring with other magnetic circuit components such as washer, main magnet and secondary magnet are optimized, so that the deformation of the shading ring in production and use can be reduced, the influence of overflowed adhesive to a product is prevented, the overall acoustic performance of a loudspeaker is improved, and the tone quality of the loudspeaker is improved.

To this end, the present invention provides the following technical solutions.

A shading ring is configured to be disposed in a magnetic circuit system. The magnetic circuit system includes a main magnet, a washer, a voice coil and a secondary magnet; the shading ring is located inside the voice coil. The shading ring includes a first ring body and a second ring body. The second ring body is formed by bending a lower end of the first ring body outward. The first ring body includes a first perpendicular portion and a first horizontal portion; a first cavity is formed inside the first perpendicular portion. The secondary magnet is located in the first cavity. The first horizontal portion is fixedly connected to an upward side of the secondary magnet.

The shading ring is of a double-ring structure, and includes a first ring body and a second ring body. A diameter of the first ring body is smaller than a diameter of the second ring body. The first ring body and the second ring body are moulded integrally in general, i.e., the second ring body is formed by bending the lower end (lower edge) of the first ring body outward, and may also be formed into the double-ring structure via manners such as an adhesive manner and a welding manner.

The first ring body of the shading ring is fixedly connected to the upward side of the secondary magnet, with the connection manner being a fixing manner such as buckled connection and adhered connection, and the secondary magnet is located in the first cavity of the first ring body, so that the influence of a repulsive force between the main magnet and the secondary magnet to the shading ring in use may be reduced or even eliminated, the deformation of the shading ring is reduced, the inductance of the voice coil is effectively reduced, the frequency response of the loudspeaker is improved, the distortion of the loudspeaker is improved, and the overall acoustic performance of the loudspeaker is guaranteed.

As an exemplary technical solution, a gasket is disposed on the secondary magnet, and the first horizontal portion is fixedly connected to the gasket. According to a requirement of a magnetic circuit in design, the low carbon steel gasket is disposed on the secondary magnet; and at this time, the first horizontal portion of the shading ring directly contacts the gasket and is fixedly connected to an upward side of the gasket.

As an exemplary technical solution, the second ring body includes a second perpendicular portion and a second horizontal portion; a second cavity is formed inside the second perpendicular portion. The washer and a part of the main magnet are located in the second cavity; and the second horizontal portion is fixedly connected to an upward side of the washer.

As an exemplary technical solution, the shading ring is made of copper or aluminum.

The present invention further provides a loudspeaker, including a U yoke, a main magnet, a washer, a voice coil, a secondary magnet and a shading ring. The main magnet, the washer and the secondary magnet are sequentially disposed on a bottom of the U yoke. The voice coil is disposed outside the washer. The shading ring is located inside the voice coil. The shading ring includes a first ring body and a second ring body. The second ring body is formed by bending a lower end of the first ring body outward. The first ring body includes a first perpendicular portion and a first horizontal portion. A first cavity is formed inside the first perpendicular portion. The secondary magnet is located in the first cavity. The first horizontal portion is fixedly connected to an upward side of the secondary magnet.

As an exemplary technical solution, the loudspeaker further includes a gasket. The gasket is disposed on the secondary magnet. The gasket and the secondary magnet are jointly located in the first cavity. The first horizontal portion is fixedly connected to an upward side of the gasket.

As an exemplary technical solution, the second ring body includes a second perpendicular portion and a second horizontal portion; a second cavity is formed inside the second perpendicular portion; the washer and a part of the main magnet are located in the second cavity; and the second horizontal portion is fixedly connected to an upward side of the washer.

The present invention further provides another loudspeaker, including a T yoke, a main magnet, a washer, a voice coil, a secondary magnet and a shading ring. The T yoke includes a transversal portion and a vertical portion perpendicularly disposed on a center of the transversal portion. The secondary magnet is located on the vertical portion. The voice coil is disposed inside the washer. The shading ring is located inside the voice coil. The shading ring includes a first ring body and a second ring body. The second ring body is formed by bending a lower end of the first ring body outward. The first ring body includes a first perpendicular portion and a first horizontal portion. A first cavity is formed inside the first perpendicular portion. The secondary magnet is located in the first cavity. The first horizontal portion is fixedly connected to an upward side of the secondary magnet.

As an exemplary technical solution, the loudspeaker further includes a gasket. The gasket is disposed on the secondary magnet. The gasket and the secondary magnet are jointly located in the first cavity. The first horizontal portion is fixedly connected to an upward side of the gasket.

As an exemplary technical solution, the second ring body includes a second perpendicular portion and a second horizontal portion. A second cavity is formed inside the second perpendicular portion. A part of the vertical portion of the T yoke is located in the second cavity. The second horizontal portion is fixedly connected to an upward side of the vertical portion.

Based on the above technical solutions, the present invention achieves the following technical effects:

(1) According to the shading ring provided by the present invention, the structure is original; and by disposing the shading ring in the magnetic circuit system of the loudspeaker and optimizing the connection relationships of the shading ring with other components such as the main magnet, the secondary magnet and the washer, the influence of the repulsive force between the main magnet and the secondary magnet to the shading ring is eliminated, the deformation of the shading ring in production and use is reduced, the influence of overflowed adhesive to a product is prevented, and the harmonic distortion and nonlinear distortion of the loudspeaker are effectively reduced.

(2) According to the loudspeaker having the novel shading ring provided by the present invention, the shading ring includes the first ring body and the second ring body, and is respectively sleeved to the magnetic circuit system of the U yoke and the magnetic circuit system of the T yoke by using different connection structures, so that the whole magnetic circuit system is stable, and the change of nonlinear inductance in the magnetic circuit system is reduced; and therefore, the distortion is reduced, the overall acoustic performance of the loudspeaker is improved, and the tone quality of the loudspeaker is improved.

DETAILED DESCRIPTION OF THE EMBODIMENTS

In order to understand the present invention conveniently, the present invention will be described more completely in combination with the accompanying drawings and specific embodiments. Preferred embodiments of the present invention are given in the accompanying drawings. However, the present invention may be implemented in many different forms, and is not limited to the embodiments described herein. On the contrary, these embodiments are provided to understand the contents of the present invention more thorough and complete.

It is to be noted that when one element is referred to as being "fixed" to other element, it may be directly on the other element or an intervening element may also be present. When one element is considered as being "connected" to the other element, it may be directly connected to the other element or an intervening element may be present simultaneously.

Unless otherwise defined, all technical and scientific terms used herein have the same meaning as commonly understood by one of ordinary skill in the art. The terms used in the specification of the present invention are merely for describing the specific embodiments and are not intended to limit the present invention.

Embodiment 1

Figure 1:
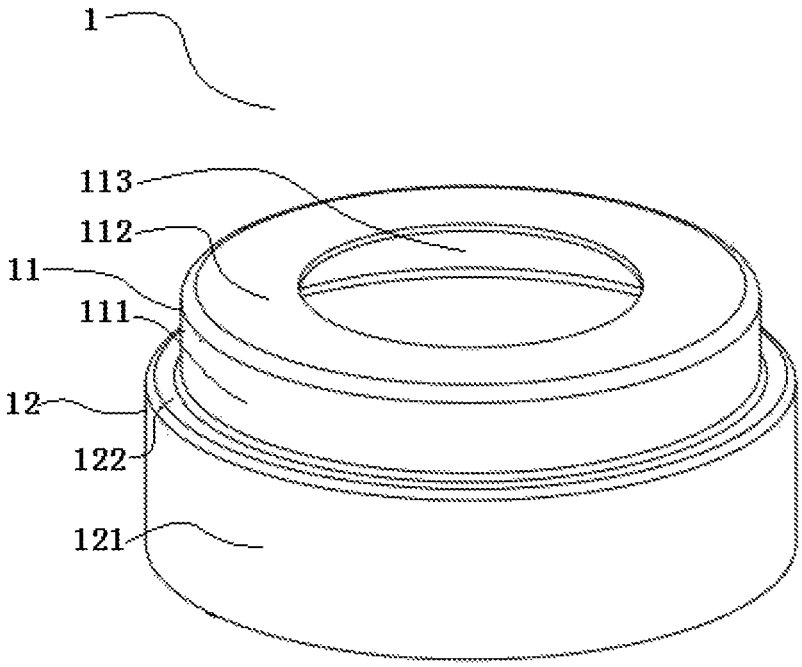
FIG. 1 is a structural schematic diagram of a shading ring of the present invention.
Figure 2:
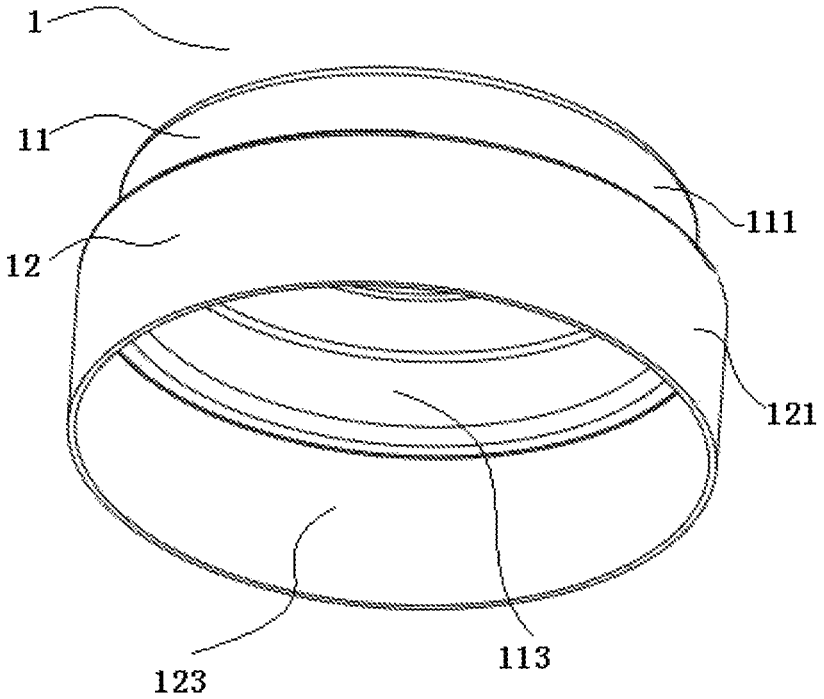
FIG. 2 is a structural schematic diagram of another view angle of a shading ring of the present invention.

FIG. 1 shows a structural schematic diagram of a shading ring in this embodiment. FIG. 2 shows a structural schematic diagram of another view angle of a shading ring in this embodiment. Referring to FIG. 1 and FIG. 2, a shading ring having a double-ring structure includes a first ring body 11 and a second ring body 12. The second ring body 12 is formed by bending a lower end (lower edge) of the first ring body 11 outward, and a diameter of the first ring body 11 is smaller than a diameter of the second ring body 12, i.e., it may be considered that the first ring body 11 is overlapped and fixed at an inner upward side of the second ring body 12.

The first ring body 11 and the second ring body 12 are molded integrally in general. A metal sheet made of a same copper or aluminum material is formed into the shading ring having the double-ring overlapped structure, and may also be formed into the double-ring structure via manners such as an adhesive manner and a welding manner. In this embodiment, the shading ring is preferably made of copper and may be made into a light thin body.

Referring to FIG. 1 and FIG. 2 continuously, the first ring body 11 includes a first perpendicular portion 111 and a first horizontal portion 112. A first cavity 113 is formed inside the first perpendicular portion. The second ring body 12 includes a second perpendicular portion 121 and a second horizontal portion 122. A second cavity 123 is formed inside the second perpendicular portion.

As a component of the magnetic circuit system, the shading ring lies in that the connection relationships with other components of the magnetic circuit system are as follows: the first ring body is fixedly connected to a secondary magnet or a gasket via a buckled or adhered fixing manner; and meanwhile, the secondary magnet or the gasket is located in the first cavity, and the second ring body is directly and fixedly connected to a washer or the magnet.

It is to be noted that, in a production process of the magnetic circuit system having such a shading ring, a main magnet, a washer, a secondary magnet and a gasket are combined first to form a magnetic circuit module generally; after the adhesive is applied, the whole magnetic circuit module is placed into a first cavity and a second cavity of the shading ring; and in this way, the phenomenon of the deformation of the shading ring in production may be reduced, the adverse effect of the overflowed adhesive to a loudspeaker product may further be prevented, and the shading ring is guaranteed to take the effect of reducing the harmonic distortion and nonlinear distortion of the loudspeaker in use.

Figure 3:
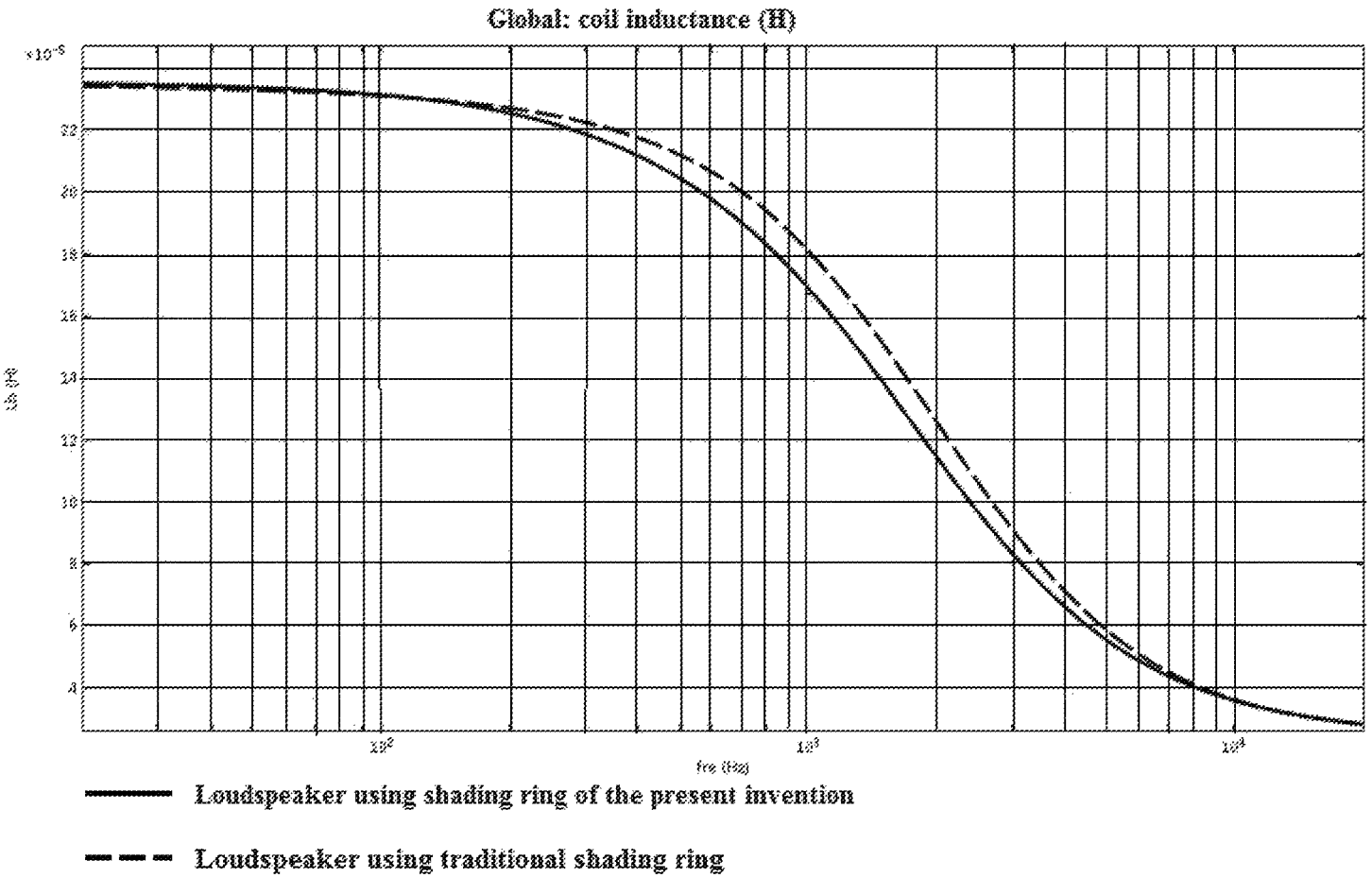
FIG. 3 is a comparison curve graph of an inductance Lb between a loudspeaker using a shading ring of the present invention and a loudspeaker using a traditional shading ring.

FIG. 3 shows a comparison curve graph of an inductance Lb between a loudspeaker using a shading ring in this embodiment and a loudspeaker using a traditional shading ring. As can be seen from FIG. 3, by using the loudspeaker provided by this embodiment, the inductance LB is attenuated obviously at 200 Hz-14 kHz, and the distortion is improved obviously.

Embodiment 2

Figure 4:
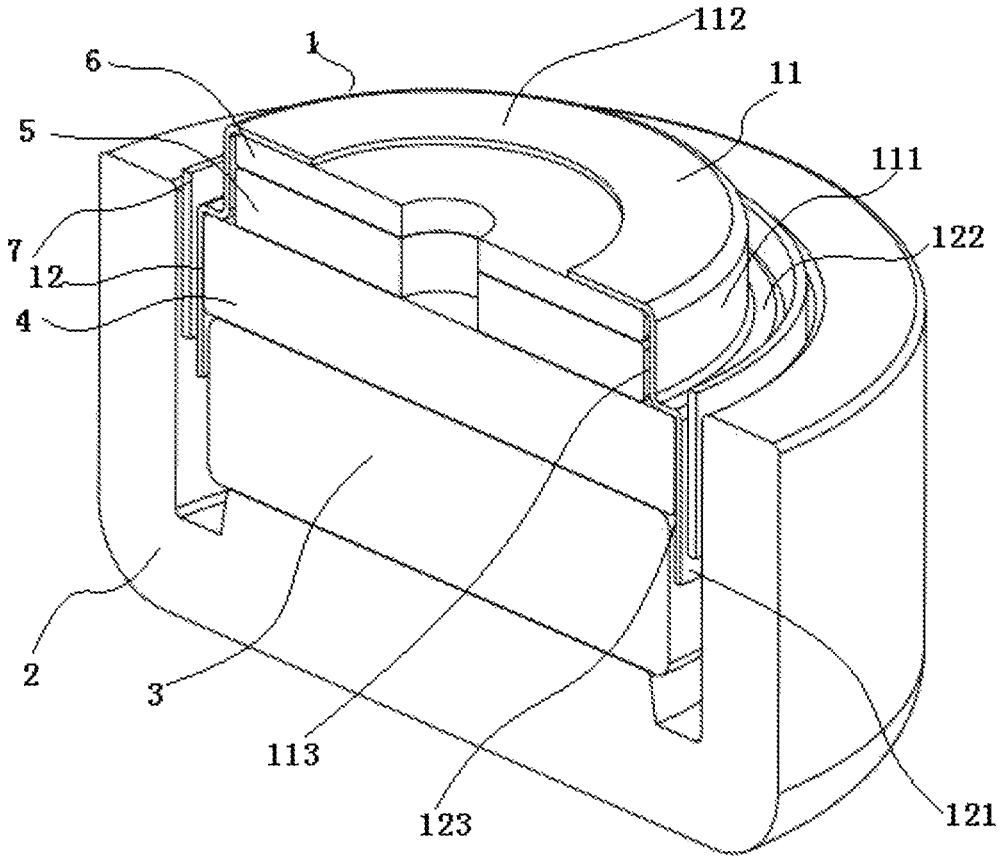
FIG. 4 is a sectional structural diagram of a loudspeaker in an embodiment of the present invention.
Figure 5:
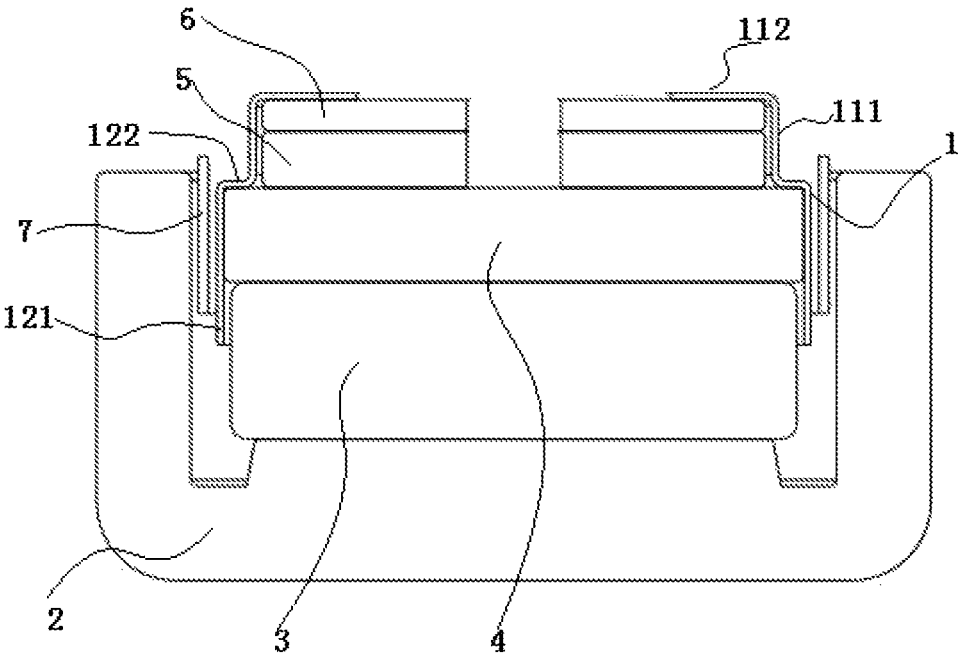
FIG. 5 is a sectional view of a loudspeaker in an embodiment of the present invention.
Figure 6:
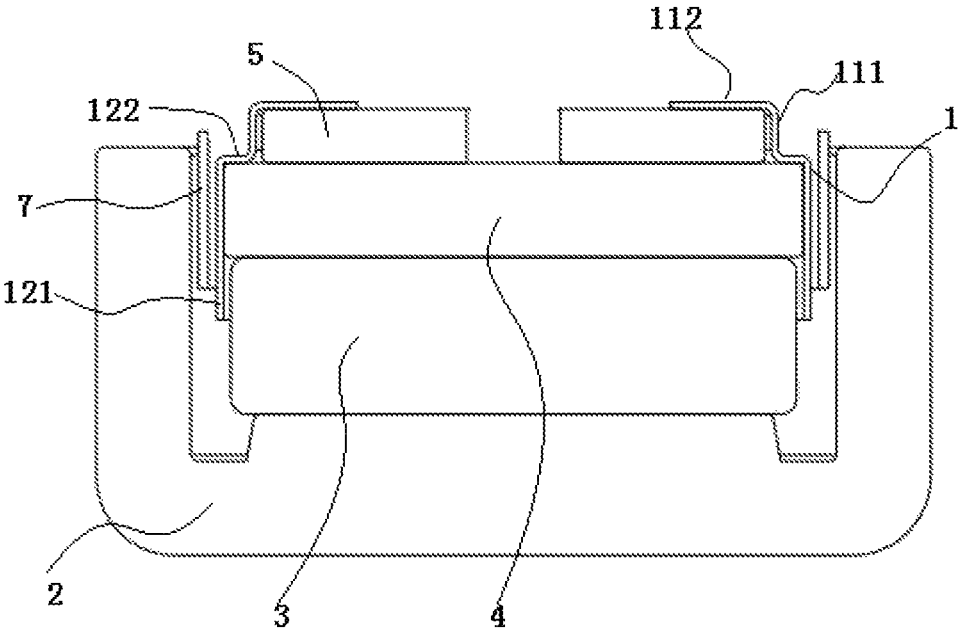
FIG. 6 is a sectional view of a loudspeaker without a gasket in an embodiment of the present invention.

FIG. 4 shows a sectional structural diagram of a loudspeaker in this embodiment. FIG. 5 shows a sectional view of a loudspeaker in this embodiment. FIG. 6 shows a sectional view of a loudspeaker without a gasket in this embodiment. Referring to FIG. 4 and FIG. 5 first, a loudspeaker includes a shading ring 1 having a double-ring structure, as well as a U yoke 2, a main magnet 3, a washer 4, a secondary magnet 5, a gasket 6 and a voice coil 7. For the internal magnetic type loudspeaker, the main magnet 3, the washer, the secondary magnet 5 and the gasket 6 in a magnetic circuit system are sequentially disposed on a bottom of the U yoke, the voice coil 7 is sleeved outside the washer 4, and the shading ring 1 is located inside the washer 7. In this embodiment, the gasket 6 made of a low carbon magnetic steel is disposed on the secondary magnet 5.

It is to be noted that, in this embodiment, the shading ring 1 includes a first ring body 11 and a second ring body 12. The second ring body 12 is formed by bending a lower end of the first ring body 11 outward, i.e., a ladder-shaped structure is formed between the first ring body 11 and the second ring body 12.

The first ring body 11 includes a first perpendicular portion 111 and a first horizontal portion 112. A first cavity 113 is formed inside the first perpendicular portion. The secondary magnet 5 and the gasket 6 are located in the first cavity 113. The first horizontal portion 112 is fixedly connected to an upward side of the gasket 6. Such a fixed connection manner is adhered connection and (or) buckled connection, i.e., the first horizontal portion is fixedly connected to the gasket via an adhered or buckled manner; and outsides of the secondary magnet and the gaskets are in adhered connection with an inside of the first perpendicular portion.

The second ring body 12 includes a second perpendicular portion 121 and a second horizontal portion 122. A second cavity 123 is formed inside the second perpendicular portion and the second horizontal portion 122 is fixedly connected to an upward side of the washer 4. Such a fixed connection manner is adhered connection and (or) buckled connection, i.e., the second horizontal portion is fixedly connected to the washer via an adhered or buckled manner; and at this time, the washer 4 and a part of the main magnet are located in the second cavity 123, i.e., an outside of the washer 4 and an outside of the part of the main magnet are in adhered connection with an inside of the second perpendicular portion.

In some embodiments, referring to the sectional view of the loudspeaker without the gasket in this embodiment in FIG. 6, i.e., no gasket is provided on the secondary magnet, in the shading ring at this time, the first horizontal portion 112 of the first ring body is directly and fixedly connected to an upward side of the secondary magnet 5, the first horizontal portion 112 is fixedly connected to the secondary magnet 5 via an adhered or buckled manner, and an outside of the secondary magnet is in adhered connection with an inside of the first perpendicular portion.

In a production process of the loudspeaker, the main magnet 3, the washer 4, the secondary magnet 5 and the gasket 6 are formed into a magnetic circuit module first; and then the magnetic circuit module is adhered and may be directly placed into the shading ring; and in this way, the phenomenon of the deformation of the shading ring in production may be reduced, and the adverse effect of the overflowed adhesive to the loudspeaker product may further be prevented.

In addition, according to the shading ring provided by this embodiment, by optimizing the connection relationships of the shading ring with other components such as the main magnet, the secondary magnet and the washer, the influence of a repulsive force between the main magnet and the secondary magnet to the shading ring is eliminated, the deformation of the shading ring in production and use is reduced, the harmonic distortion and nonlinear distortion of the loudspeaker are effectively reduced, the whole magnetic circuit system is stable, the change of the nonlinear inductance in the magnetic circuit system is reduced, the overall acoustic performance is improved, and the tone quality of the loudspeaker is improved.

Embodiment 3

Figure 7:
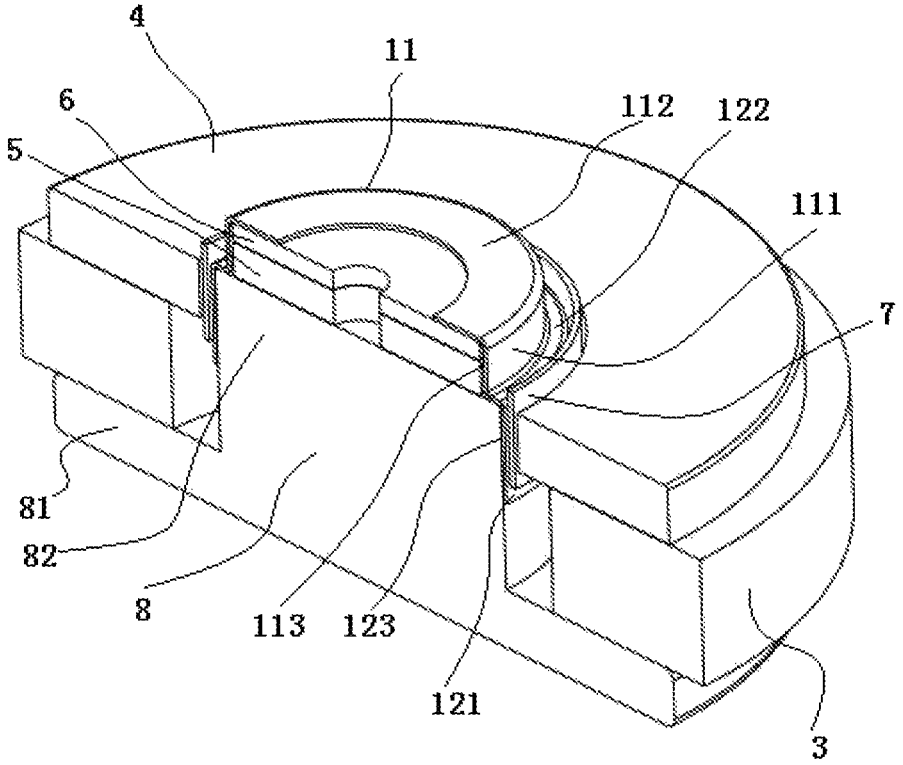
FIG. 7 is a sectional structural diagram of a loudspeaker in another embodiment of the present invention.
Figure 8:
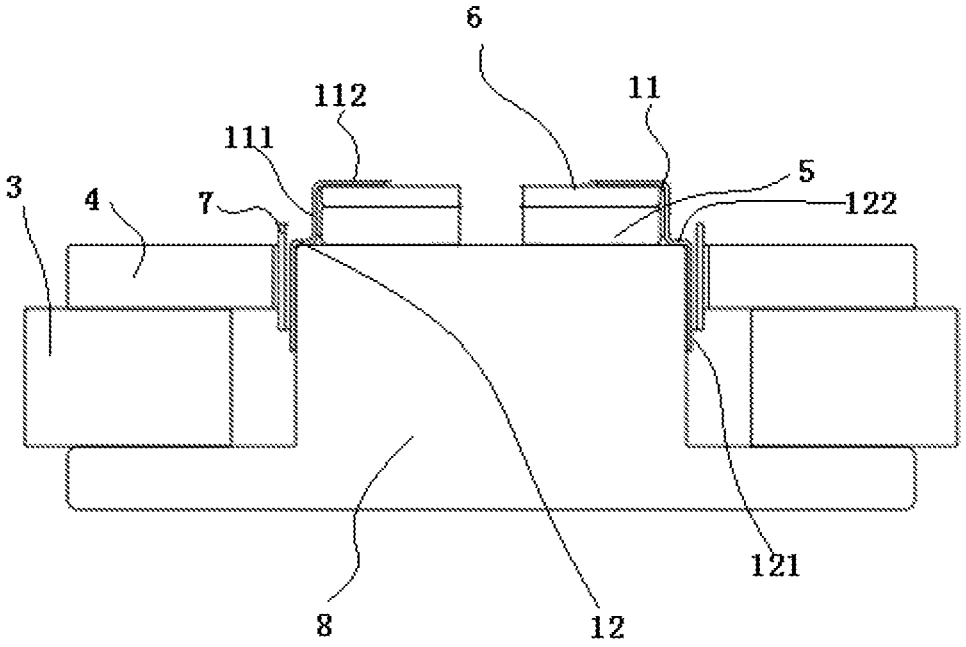
FIG. 8 is a sectional view of a loudspeaker in another embodiment of the present invention.
Figure 9:
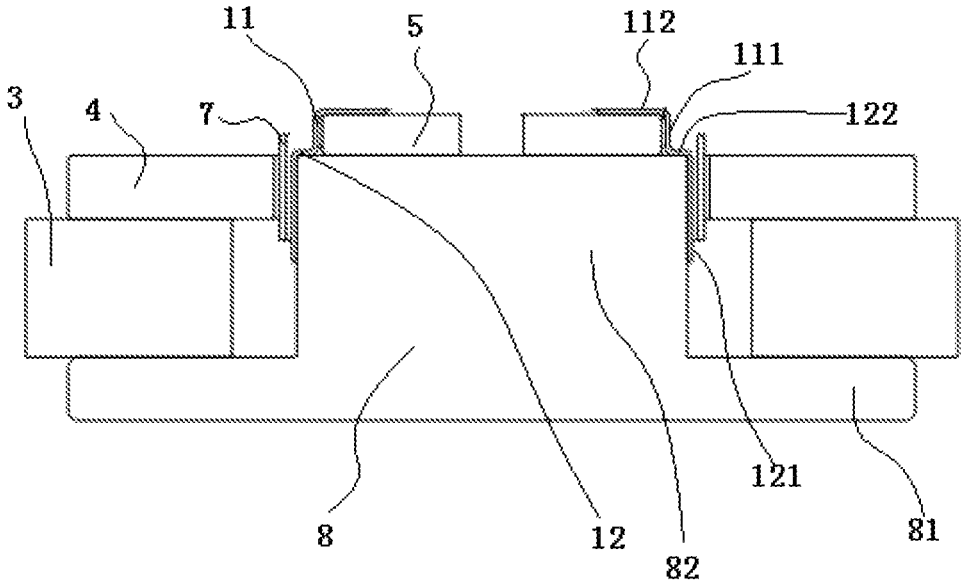
FIG. 9 is a sectional view of a loudspeaker without a gasket in another embodiment of the present invention.

FIG. 7 shows a sectional structural diagram of a loudspeaker in this embodiment, FIG. 8 shows a sectional view of a loudspeaker in this embodiment, and FIG. 9 shows a sectional view of a loudspeaker without a gasket in this embodiment. In this embodiment, the loudspeaker is an external magnetic type loudspeaker. Referring to FIG. 7 and FIG. 8, a loudspeaker includes a shading ring 1 having a double-ring structure, as well as a T yoke 8, a main magnet 3, a washer 4, a secondary magnet 5, a gasket 6 and a voice coil 7. For the external magnetic type loudspeaker, the T yoke includes a transversal portion 81 and a vertical portion 82 perpendicularly disposed on a center of the transversal portion. The main magnet 3 and the washer 4 in a magnetic circuit system are located on the transversal portion 81, the secondary magnet 5 and the gasket 6 are located on the vertical portion 82, the voice coil 7 is disposed inside the washer 4, and further, the shading ring is located inside the voice coil 7. In this embodiment, the gasket 6 made of a low carbon magnetic steel is disposed on the secondary magnet 5.

It is to be noted that, in this embodiment, the shading ring 1 includes a first ring body 11 and a second ring body 12 and the second ring body 12 is formed by bending a lower end of the first ring body 11 outward, i.e., a ladder-shaped structure is formed between the first ring body 11 and the second ring body 12.

The first ring body 11 includes a first perpendicular portion 111 and a first horizontal portion 112. A first cavity 113 is formed inside the first perpendicular portion. The secondary magnet 5 and the gasket 6 are located in the first cavity 113. The first horizontal portion 112 is fixedly connected to an upward side of the gasket 6. Such a fixed connection manner is adhered connection and (or) buckled connection, i.e., the first horizontal portion is fixedly connected to the gasket via an adhered or buckled manner; and outsides of the secondary magnet and the gaskets are in adhered connection with an inside of the first perpendicular portion.

The second ring body 12 includes a second perpendicular portion 121 and a second horizontal portion 122. A second cavity 123 is formed inside the second perpendicular portion and the second horizontal portion 122 is fixedly connected to an upward side of the vertical portion 82 of the T yoke. Such a fixed connection manner is adhered connection and (or) buckled connection, i.e., the second horizontal portion is fixedly connected to the upward side of the T yoke via an adhered or buckled manner; and at this time, a part of the vertical portion of the T yoke is located in the second cavity 123, i.e., an outside of the part of the vertical portion is in adhered connection with an inside of the second perpendicular portion.

In some embodiments, referring to the sectional view of the loudspeaker without the gasket in this embodiment in FIG. 9, i.e., no gasket is provided on the secondary magnet, in the shading ring at this time, the first horizontal portion 112 of the first ring body is directly and fixedly connected to an upward side of the secondary magnet 5, the first horizontal portion 112 is fixedly connected to the secondary magnet 5 via an adhered or buckled manner, and an outside of the secondary magnet 5 is in adhered connection with an inside of the first perpendicular portion.

In a production process of the loudspeaker, the T yoke 8, the secondary magnet 5 and the gasket 6 are formed into a magnetic circuit module first; and then the magnetic circuit module is adhered and may be directly placed into the shading ring; and in this way, the phenomenon of the deformation of the shading ring in production may be reduced, and the adverse effect of the overflowed adhesive to the loudspeaker product may further be prevented.

The above contents are merely examples and explanations for the structure of the present invention, and the description is specific and detailed but cannot be accordingly understood as limits to a patent scope of the present invention. It should be pointed out those of ordinary skill in the art may further make a plurality of variations and improvements without departing from the concept of the present invention, and these apparent replacement forms all pertain to the protection scope of the present invention.

The invention claimed is:

1. A shading ring, configured to be disposed in a magnetic circuit system, the magnetic circuit system comprising a main magnet, a washer, a voice coil and a secondary magnet, the shading ring being located inside the voice coil, the shading ring comprising:

a first ring body, comprising:
- a first perpendicular portion;
- a first horizontal portion; and
- a first cavity formed inside the first perpendicular portion; and a second ring body, and wherein the first cavity is configured to receive the secondary magnet, and wherein the first horizontal portion is configured to be fixedly connected to an upward side of the secondary magnet.

2. The shading ring according to claim 1, wherein a gasket is disposed on the secondary magnet and the first horizontal portion is configured to be fixedly connected to the gasket.

3. The shading ring according to claim 1, wherein the second ring body comprises:

a second perpendicular portion;

a second horizontal portion; and a second cavity formed inside the second perpendicular portion wherein the second cavity is configured to receive the washer and a part of the main magnet are located in the second cavity, and wherein the second horizontal portion is configured to be fixedly connected to an upward side of the washer.

4. The shading ring according to claim 1, wherein the shading ring is made of copper or aluminum.

5. A loudspeaker, comprising:

a U yoke;

a main magnet;

a washer;

a voice coil disposed outside of the washer;

a secondary magnet; and a shading ring located inside the voice coil, the shading ring comprising:

a first ring body, comprising:
- a first perpendicular portion;
- a first horizontal portion; and
- a first cavity formed inside the first perpendicular portion; and a second ring body, wherein the main magnet, the washer and the secondary magnet are sequentially disposed on a bottom of the U yoke, wherein the secondary magnet is located in the first cavity, and wherein the first horizontal portion is fixedly connected to an upward side of the secondary magnet.

6. The loudspeaker according to claim 5, comprising a gasket disposed on the secondary magnet, wherein the gasket and the secondary magnet are jointly located in the first cavity, and wherein the first horizontal portion is fixedly connected to an upward side of the gasket.

7. The loudspeaker according to claim 5, wherein the second ring body comprises:

a second perpendicular portion;

a second horizontal portion; and a second cavity formed inside the second perpendicular portion, wherein the washer and a part of the main magnet are located in the second cavity, and wherein the second horizontal portion is fixedly connected to an upward side of the washer.

8. A loudspeaker, comprising:

a T yoke, comprising:

a transversal portion; and a vertical portion disposed perpendicularly on a center of the transversal portion;

a main magnet;

a washer;

a voice coil disposed inside the washer;

a secondary magnet; and a shading ring located inside the voice coil, the voice coil comprising:

a first ring body, comprising:

a first perpendicular portion;

a first horizontal portion; and a cavity formed inside the first perpendicular portion; and a second ring body, wherein the secondary magnet is located on the vertical portion, wherein the secondary magnet is located in the first cavity, and wherein the first horizontal portion is fixedly connected to an upward side of the secondary magnet.

9. The loudspeaker according to claim 8, further comprising a gasket, wherein the gasket is disposed on the secondary magnet, wherein the gasket and the secondary magnet are jointly located in the first cavity, and wherein the first horizontal portion is fixedly connected to an upward side of the gasket.

10. The loudspeaker according to claim 8, wherein the second ring body comprises:

a second perpendicular portion;

a second horizontal portion; and a second cavity formed inside the second perpendicular portion, wherein a part of the vertical portion of the T yoke is located in the second cavity, and wherein the second horizontal portion is fixedly connected to an upward side of the vertical portion.

* * * * *